United States Patent [19]

Nagel et al.

[11] 4,319,744

[45] Mar. 16, 1982

[54] JOGGER FOR THE LATERAL ALIGNMENT OF SHEETS IN SHEET DELIVERERS

[75] Inventors: Hartmut Nagel; Hans Zimmermann, both of Coswig; Fritz Pieper, Radebeul; Dieter Plage, Coswig, all of German Democratic Rep.

[73] Assignee: Veb Kombinat Polygraph "Werner Lamberz" Leipzig, Leipzig, German Democratic Rep.

[21] Appl. No.: 115,285

[22] Filed: Jan. 25, 1980

[30] Foreign Application Priority Data

Feb. 1, 1979 [DD] German Democratic Rep. ... 210749

[51] Int. Cl.[3] ..... B65H 31/36

[52] U.S. Cl. ..... 271/222

[58] Field of Search ..... 271/221, 222, 210

[56] References Cited

U.S. PATENT DOCUMENTS 2,992,823 7/1961 Forrester ..... 271/222
3,022,999 2/1962 Mead ..... 271/221 X
3,165,956 1/1965 Thumim ..... 271/222 X
3,370,848 2/1968 Bartlett ..... 271/222 X

FOREIGN PATENT DOCUMENTS 2751525 12/1978 Fed. Rep. of Germany ..... 271/221

*Primary Examiner*—Richard A. Schacher
*Attorney, Agent, or Firm*—Michael J. Striker

[57] ABSTRACT

A jogger for lateral alignment of sheets in a sheet-delivering device of a sheet-processing machine, such as a printing machine, has displaceable diaphragm; resiliently yieldable member; and a pusher member connected with the diaphragm and the resiliently yieldable member so that upon displacement of the diaphragm in one direction, the pusher member first moves toward a sheet-delivery device against the force of the resiliently yieldable member and then tilts after contacting a sheet stack in the sheet-delivery device, wherein the diaphragm is elastic and pneumatically impingeable to perform the displacement, so that the pusher member automatically adjusts upon the sheet stack.

12 Claims, 3 Drawing Figures

JOGGER FOR THE LATERAL ALIGNMENT OF SHEETS IN SHEET DELIVERERS

BACKGROUND OF THE INVENTION

The invention relates to a jogger for the lateral alignment of sheets in sheet deliverers of sheet processing machines, particularly printing presses.

By the German Democratic Republic Design Patent No. 18 164, a jogger has become known, the pusher plate of which, actuated by a pneumatic cylinder acts against the stack edge.

It is of disadvantage in this jogger that the pusher plate acts against the stack edge with a constant force and its entire area, so that sheets which are already a constituent of the stack are still influenced by the pusher plate. Damage to the sheets may thus be caused.

Furthermore, pneumatic actuation of the jogger is complicated, and adjustment for various sheet sizes difficult, since the effect of the impulses upon the stack will depend upon the distance of the jogger from the stack.

SUMMARY OF THE INVENTION

It is the objective of the invention to create a pneumatically operated jogger, of simple construction, allowing, at small expenditure, adjustment to varying paper sizes, and enabling exact stack-forming for all types of paper without damage to the sheet.

It is the task of the invention to create a jogger which corresponding to the location of the stack edge, will automatically adjust the effect of its impulses upon the aligned sheet.

As per invention, this task is resolved by attaching the pusher plate which, after contacting the delivered stack will perform a tilting movement, to a leaf spring and fixedly attaching to the pusher plate a threaded bolt arranged within a pneumatically actuated rubber diaphragm. The rubber diaphragm is herein constructed as part of an air chamber which, during operation of the machine, may be impinged by air through a throttle valve adjustable either manually or automatically. The leaf spring, fixedly connected to the jogger plate is arranged at the intermediate piece. A lock nut provided on the threaded bolt serves for adjusting the stroke.

The jogger may be actuated or shut off during operation of the machine by means of the select valve.

By the solution as per invention, any type of paper may be processed, with stack forming better than with joggers known hitherto and without the sheet edge being damaged by the pusher plate. The pusher plate will act herein upon the lateral edge of the stack by an impulse adjustable to the paper stiffness, but not influencing the position of the sheet. Having contacted the delivered stack, the jogger will, under the effect of the tilting momentum generated by the threaded bolt and the leaf spring, itself tilt about the stack edge into the zone above the delivered stack and act upon the sheets in their floating phase. Herein, the pusher plate will automatically adjust itself to the upper edge of the stack. The resistance of the upper edge of the stack and of the sheet, the spring force of the leaf spring and the rubber diaphragm, will act against the pressure prevailing in the air chamber, so that an optimal pressure adjustment will allow the exerting of a soft effect of the impulses upon the sheet which will not damage the sheet to be aligned.

A further advantage of the swinging-in of the stacking plate over the delivered stack is, that it will also be possible to obtain a well-aligned stack with sheets of differing cuts.

The jogger has a simple pneumatic actuator, produceable and useable at low expenditure. The jogger will work with little wear and is of secure operation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
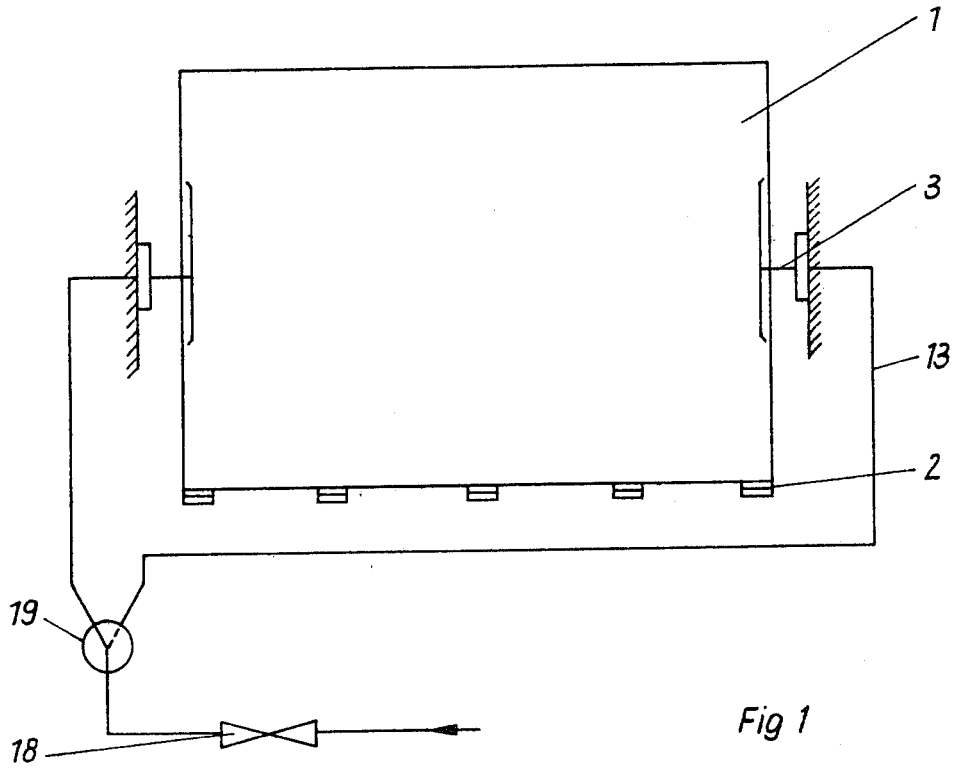
FIG. 1 is a top view of a schematic representation of the delivered stack with the jogger.
Figure 2:
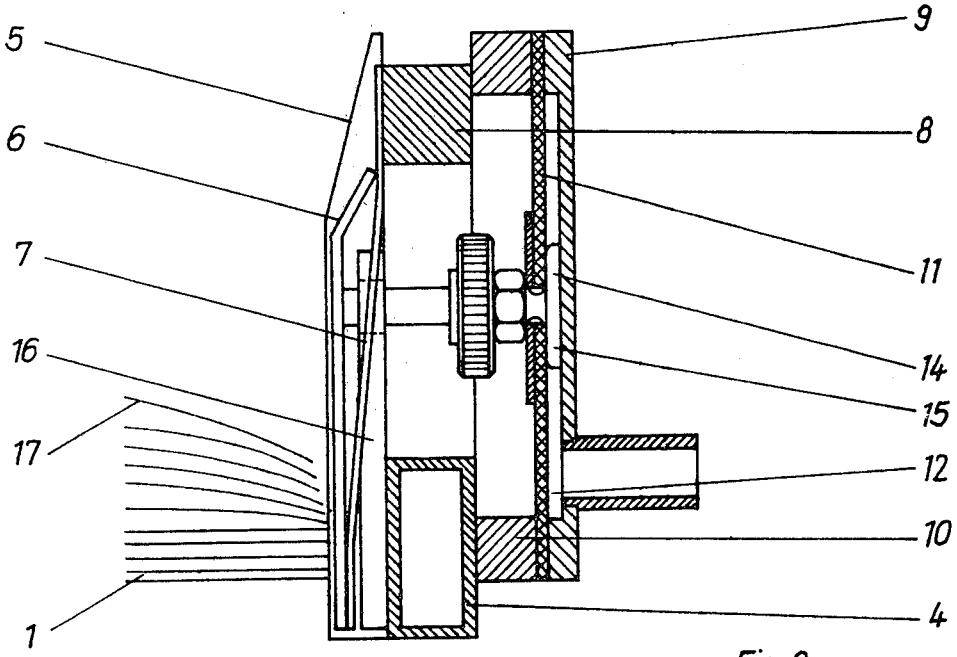
FIG. 2 is a side view of the jogger in resting phase.
Figure 3:
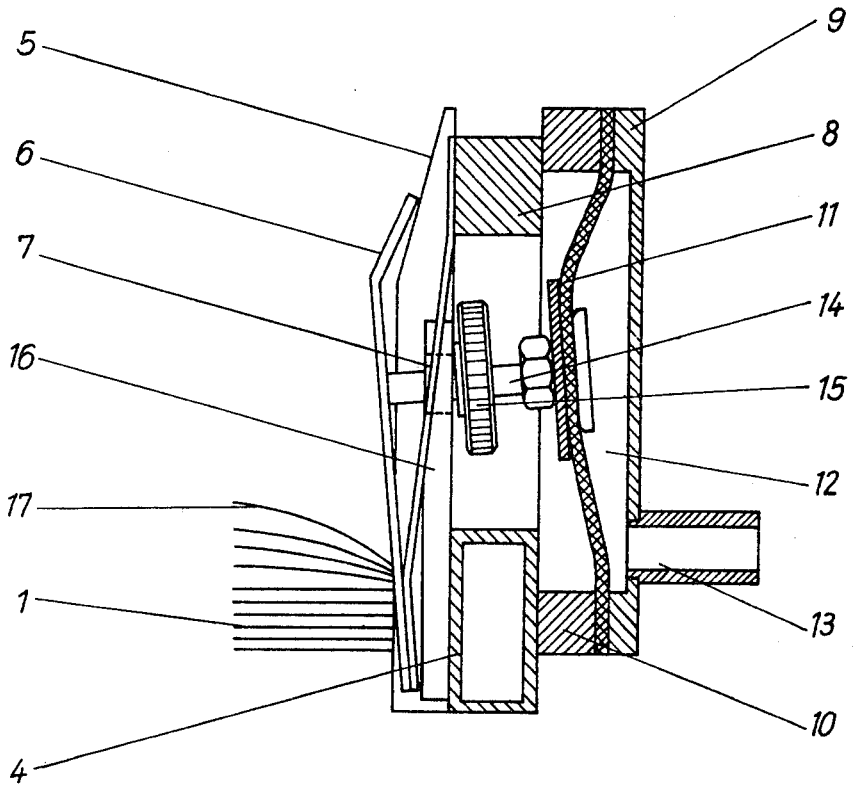
FIG. 3 is a side view of the jogger in aligning phase.

FIG. 1 shows a simplified top view onto a deliverer stack 1, with sheet stops 2 arranged at its front edge. Joggers 3 are placed laterally to the deliverer stack 1, attached to a rail 4 and movable longitudinally to the latter. Fixed stops 5 are also arranged at the rail 4. The rail 4 is attached, in the manner as known, to the deliverer side walls, not shown. The joggers 3 are adjustable to a respectively used sheet size. As shown in FIGS. 2 and 3, the jogger 3 consists of a pusher plate 6, with a leaf spring 7 at its lower edge, the other end of the spring being connected to an intermediate piece 8. At the side not facing the deliverer stack 1, the jogger 3 is closed at its perimeter by a cover 9 connected over a spacer 10 to the intermediate piece 8 and, respectively, the rail 4. A rubber diaphragm 10 is located between an cover 9 and the spacer 10, forming, together with the cover 9 an air chamber 12. A connection for the air supply line 13 is provided within the cover 9. The air supply line 13 is connected to an air supply device, not shown, over a selector valve 19 and a throttle valve 18. A threaded bolt 14 with a lock nut 15 is fixedly arranged at the rubber diaphragm 11 and the pusher plate 6. The lock nut 15 serves for adjusting or limiting the stroke. A stop 16, provided with a bore to accommodate the threaded bolt 14, serves to limit the stroke.

Operation of the device as per invention is as follows: A means of transportation not shown, for instance a gripper carriage, serves for continually delivering sheets 17 above the deliverer stack 1, whereafter the sheets are released and stacked. The sheet 17 will herein automatically adjust itself by its front edge along the sheet stops 2. The lateral sheet position is limited by the sheet stops 5 and influenced by the jogger 3 with its operation as follows.

The air chamber 12 is impinged over the air supply line 13 with single or multiple impulses coinciding with the cadence of each consecutive sheet. This will cause a higher pressure within the air chamber 12 and the rubber diaphragm 11 with the threaded bolt 14 and the pusher plate 6, are moved against the force of the leaf spring 7 and in the direction of the deliverer stack 1, where the pusher plate 6 will act upon the sheet 17. The pusher plate 6 is herein executing a rectilinear or, respectively, approximately rectilinear motion, until it contacts the deliverer stack. When the pusher plate 6 has contacted the deliverer stack 1, the pusher plate 6 will tilt until the lock nut 15, serving for adjusting the stroke of the threaded bolt 11, abuts the stop 16, the pusher plate 6 will tilt about the stack edge and into the deliverer stack 1 and will act upon the sheet 17 which is in its dropping phase. Interrupting the air supply, the air supply being adjustable during machine operation by the throttle valve 18, will cause the threaded bolt 14 and the pusher plate 6 to return to their initial position by the action of the leaf spring 7 and the rubber diaphragm 11. (FIG. 2).

The selector valve 19 allows optional air supply during machine operation, either to one or both joggers 3, or optionally interrupting it.

The drawing shows that the fixed stops 5 are arranged adjacent to the jogger 3. It is however, also possible to obtain a well-aligned deliverer stack without such stops 5. In the embodiment, the pusher plate is represented as a flat plate. It will, however, also be possible to design the pusher plate 6 with a convex shape in the direction of the deliverer stack, this in order to increase the exactness of alignment.

It will be understood that each of the elements described above, or two or more together, may also find a useful application in other types of constructions differing from the types described above.

While the invention has been illustrated and described as embodied in a jagger for a sheet-delivering device it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A jogger for lateral alignment of sheets in a sheet-delivering device of a sheet-processing machine, such as a printing machine, comprising a displaceable diaphragm; a resiliently yieldable member; and a pusher member connected with said diaphragm and said resiliently yieldable member so that upon displacement of said diaphragm in one direction, said pusher member first moves toward a sheet-delivering device against the force of said resiliently yieldable member and then tilts after contacting a sheet stack in the sheet-delivering device, said diaphragm being elastic and pneumatically impingeable to perform the displacement, so that said pusher member automatically adjusts upon the sheet stack.

2. A jogger as defined in claim 1, wherein said resiliently yieldable member is a leaf spring.

3. A jogger as defined in claim 1; and further comprising means for connecting said pusher member with said diaphragm and extending between the former and the latter.

4. A jogger as defined in claim 3, wherein said connecting means is a threaded bolt.

5. A jogger as defined in claim 1, wherein said pusher member is formed as a pusher plate.

6. A jogger as defined in claim 1; and further comprising means for pneumatically impinging said diaphragm, said pneumatic impinging means including an air chamber which has a wall formed by said diaphragm and communicates with a source of air providing pneumatic impulses.

7. A jogger as defined in claim 6, wherein said pneumatic impinging means also includes a throttle valve arranged between the source of air and said chamber and adjustable during operation of the machine.

8. A jogger as defined in claim 4; and further comprising means for adjusting the movement of said pusher member and cooperating with said threaded bolt.

9. A jogger as defined in claim 8, wherein said diaphragm, resiliently yieldable member and pusher member together form a first jogger element; and further comprising a second such diaphragm, resiliently yieldable member and pusher member together forming a second such jogger element, said stack-delivering device having two opposite sides, and said jogger elements being arranged at said opposite sides and selectively actuable and stoppable.

10. A jogger as defined in claim 9; and further comprising means for selectively actuating and stopping said jogger elements, and including a selector valve connected with the diaphragms of said jogger elements.

11. A jogger as defined in claim 8, wherein said adjusting means includes a lock nut which is screwed on said threaded bolt and arranged to abut against a stop.

12. A jogger as defined in claim 2; and further comprising an intermediate member located between said diaphragm and said pusher member, said leaf spring being arranged on said intermediate member.

* * * * *